United States Patent [19]

Iwabuchi et al.

[11] Patent Number: 4,475,023

[45] Date of Patent: Oct. 2, 1984

[54] MICROWAVE HEATING APPARATUS WITH FUNDAMENTAL AND SECOND HIGHER HARMONIC CHOKES

[75] Inventors: Koji Iwabuchi, Chiba; Tadashi Funamizu, Matsudo; Tetuo Kubota, Noda, all of Japan

[73] Assignee: Hitachi Heating Appliances Co., Ltd., Chiba, Japan

[21] Appl. No.: 410,956

[22] Filed: Aug. 24, 1982

[30] Foreign Application Priority Data

| | | | |
|---|---|---|---|
| Sep. 25, 1981 | [JP] | Japan | 56-151867 |
| Oct. 15, 1981 | [JP] | Japan | 56-164463 |
| Oct. 15, 1981 | [JP] | Japan | 56-164467 |
| Mar. 3, 1982 | [JP] | Japan | 57-33243 |

[51] Int. Cl.[3] ..... H05B 6/76

[52] U.S. Cl. ..... 219/10.55 D; 219/10.55 F

[58] Field of Search ..... 219/10.55 D, 10.55 F, 219/10.55 R; 174/35 GC, 35 R

[56] References Cited

U.S. PATENT DOCUMENTS

| | | | |
|---|---|---|---|
| 2,772,402 | 11/1956 | Tomiyasu . | |
| 2,850,706 | 9/1958 | Gabriel . | |
| 3,366,918 | 1/1968 | Johnson et al. | 174/35 GC |
| 3,629,537 | 12/1971 | Haagensen | 219/10.55 D |
| 3,668,357 | 6/1972 | Kobayashi | 219/10.55 D |
| 3,767,884 | 10/1973 | Osepchuk et al. | 219/10.55 D |
| 3,789,178 | 1/1974 | Harhen | 219/10.55 D |
| 4,313,044 | 1/1982 | Staats | 219/10.55 D |
| 4,347,420 | 8/1982 | Ikeda et al. | 219/10.55 D |

FOREIGN PATENT DOCUMENTS

| | | | |
|---|---|---|---|
| 54-34151 | 3/1979 | Japan | 219/10.55 D |
| 1022103 | 3/1966 | United Kingdom | 219/10.55 D |
| 1392498 | 4/1975 | United Kingdom | 219/10.55 D |

*Primary Examiner*—Roy N. Envall, Jr.
*Assistant Examiner*—Philip H. Leung
*Attorney, Agent, or Firm*—Antonelli, Terry & Wands

[57] ABSTRACT

A microwave heating apparatus having a door equipped with a microwave attenuating cavity constituted by a fundamental wave choke channel and a second higher harmonic choke channel opposing thereto back to back. A wall surface defining the second higher harmonic choke channel has a periodic structure provided with a plurality of trapezoidal metal pieces a tip of each of which is bent inwards. The periodic structure efficiently guides leakage microwave energy into the microwave attenuating cavity and promotes microwave energy leakage preventive effect. The door is suitable for reduction in size and thickness and permits a microwave heating apparatus of improved space factor to be provided.

5 Claims, 12 Drawing Figures

MICROWAVE HEATING APPARATUS WITH FUNDAMENTAL AND SECOND HIGHER HARMONIC CHOKES

This invention relates to a microwave heating apparatus and more particularly to a microwave heating apparatus equipped with a microwave energy leakage preventive choke channel and being suitable for heat treatment of an object to be heated such as foodstuffs.

In recent years, small-sized and multifunctional electronic parts such as integrated circuits and a microcomputer have been positively incorporated into a control circuit of a microwave heating apparatus, and improvement has been made in reduction in size and thickness of an operation panel of the apparatus. Under the circumstances, materialization of a thin door commensurate with the operation panel has been desired. Further, a so-called high space factor microwave heating apparatus has been desired in which the heating chamber occupies a large portion in relation to the overall size of the apparatus, and reduction in size and thickness of the door is essential and significant in materializing such an apparatus.

The door as applied to the microwave heating apparatus of the type set forth above typically has a choke channel combined with a microwave energy absorber such as a ferrite material. Such a ferrite material has to be applied, however, to the door to extend along its circumferential edge, resulting in increase in cost of the apparatus.

Further, proposals have heretofore been made to enhance the attenuating efficiency of the choke channel per se. More particularly, U.S. Pat. Nos. 2,772,402 and 2,850,706 issued on Nov. 27, 1956 and Sept. 2, 1958, respectively, disclose microwave energy propagating direction regulating means constituted by conductor pieces of a length of $\lambda/4$ arranged periodically to form a so-called slit arrangement on one surface of a choke channel which has a depth of $\lambda/4$, where $\lambda$ is a wavelength used, whereby the microwave energy propagation in the direction vertical to the slit can be prevented while the microwave energy propagation in the direction parallel to the slit and vertical to the choke channel can be allowed. The regulating means disclosed in the above U.S. patents relates to a microwave energy leakage preventive structure as used for a movable joint of a waveguide.

Also, British Pat. No. 1,022,103 proposes a seal structure for a microwave heating apparatus for preventing spark from occurring at a contact interface between the peripheral edge of an access opening of the heating chamber and the door. The seal structure comprises upstanding portions of a width of $\lambda/4$ and a height of $\lambda/4$ which are arranged at an interval of $\lambda/2$ or less to surround the door, and a choke channel of a depth of $\lambda/4$ disposed on the back of the upstanding portions. In this proposal, the slots between the upstanding portions also make right angles to the choke channel, thus providing microwave energy propagating direction regulating means which promotes attenuating efficiency of the choke channel.

Like U.S. Pat. Nos. 2,772,402 and 2,850,706, U.S. Pat. No. 3,767,884 also proposes a microwave energy leakage preventive structure comprised of $\lambda/4$ length slits (slots) and a $\lambda/4$ depth choke channel and applied to a contact interface between the heating chamber and door of a microwave heating apparatus.

However, the choke channels of British Pat. No. 1,022,103 and U.S. Pat. No. 3,767,884 set forth above act only as a choke channel for a fundamental wave and hence need an additional microwave energy absorber for a higher harmonic as disclosed in U.S. Pat. No. 3,767,884, thus giving rise to a complicated door structure which impairs reduction in size and thickness of the door and reduction in cost.

Further, British Pat. No. 1,392,498 proposes a choke channel which is partitioned into two sections by a metal wall having about $\lambda/4$ length slits in order to enhance attenuating efficiency. However, this choke channel is substantially increased in size and it also impairs reduction in size and thickness of the door and reduction in cost.

It is therefore an object of the present invention to obviate the above drawbacks of the prior art apparatus.

To accomplish the above object, according to an aspect of this invention, there is provided a microwave heating apparatus comprising a heating chamber for heating an object to be heated by microwave energy, a door for opening and closing an access opening of the heating chamber, a first surface member circumferentially surrounding the access opening, a second surface member provided on the door and making surface contact with the first surface member, a projecting surface of the second surface member formed by bending a circumferential edge portion of the second surface member, substantially at right angles, a periodic structure including metal pieces which extend periodically from a peripheral edge of the door and each of which has a tip surface opposing the projecting surface member substantially in parallel relationship therewith, a fundamental wave choke channel established to extend along the back of the second surface member and having an entrance at a gap between the tip surface of the periodic structure and the projecting surface of the second surface member and a microwave propagating path of about $\frac{1}{4}$ of a wavelength used which extends in a direction vertical to the first surface member and bends in a direction parallel thereto, and a second higher harmonic choke channel established to extend along the back of the periodic structure and having the same entrance as the fundamental wave choke channel and a microwave energy propagating path of about $\frac{1}{8}$ of the used wavelength which extends in a direction vertical to the first surface member and bends in a direction parallel thereto.

Other objects and features of the invention will become apparent from a description of preferred embodiments of the invention taken in conjunction with the accompanying drawings, in which.

Figure 1:
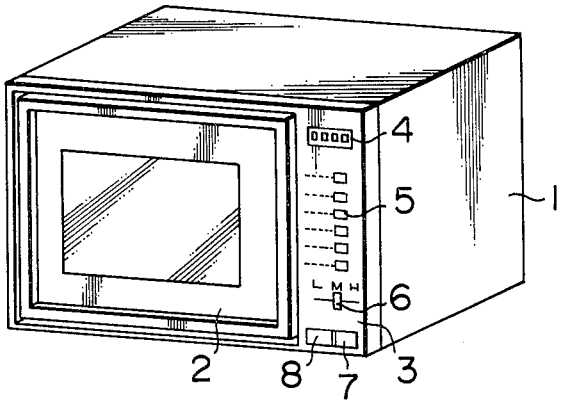
FIG. 1 is a perspective view showing a microwave heating apparatus to which the invention is applied.

Referring now to FIG. 1 showing an external apperance of a microwave heating apparatus in which the invention is embodied and which has a casing 1, a door 2, and an operation panel 3 having a thickness which is commensurate with that of the door 2. The form of the operation panel 3 is modified depending on kinds of application of the apparatus, and the operation panel illustrated herein is directed, by way of example, to automatic heating. Thus, there are provided an indicator 4 for indication of microwave energy output, residual heating time and the like, menu selecting buttons 5 for determining optimum heating patterns of different menus, a finish adjusting knob 6 for selecting the degree of finish in accordance with the user's preference, a heating button 7 to be depressed for starting heating, and a door open button 8 for opening the door.

Figure 2:
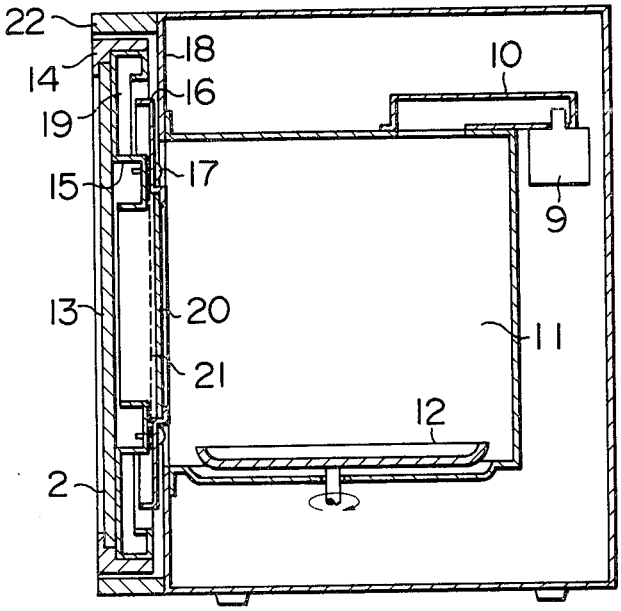
FIG. 2 is a sectional elevation showing an embodiment of the FIG. 1 microwave heating apparatus incorporating the invention.

FIG. 2 shows an embodiment of the invention as applied to the microwave heating apparatus of FIG. 1. A microwave oscillator 9 generates microwave energy, and a waveguide 10 transmits the microwave energy from the microwave oscillator 9 to a heating chamber 11. A turntable 12 assists in uniform heating and an object to be heated is placed on the turntable. For uniform heating, a stirrer, a rotary antenna or a stationary antenna may be used in lieu of the turntable 12. A transparent plate 13 in front of the door 2 is fixed to a door front plate 15 by means of a door cover 14. A door rear plate 16 is fixed to the door front plate 15 by means of screws 17. The door front plate 15 and door rear plate 16 are made of a metal plate and define a microwave energy attenuating cavity 19 opposing a metallic peripheral edge member 18 of an access opening of the heating chamber 11. A transparent plate 20 and a metal mesh (or perforated metal plate) 21 confront the heating chamber 11. The interior of the heating chamber 11 is visible or inspectable through the transparent plate 13, metal mesh 21 and transparent plate 20. A sash 22 surrounds the door 2.

Figure 3:
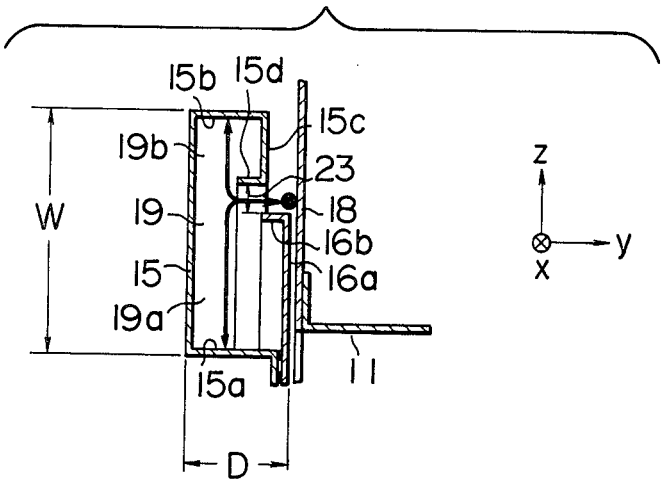
FIG. 3 is an enlarged fragmentary sectional elevation showing neighbourhood of a microwave energy attenuating cavity in FIG. 2.

FIG. 3 is an enlarged cross-section of the neighbourhood of the microwave energy attenuating cavity 19 shown in FIG. 2. A fundamental wave choke channel **19*a* for preventing microwave energy leakage of a dielectric heating frequency of, for example, 2,450 MHz opposes back to back with a second higher harmonic choke channel 19*b* for preventing microwave energy leakage of a second higher harmonic of 4,900 MHz, constituting the single microwave energy attenuating cavity 19 having an entrance 23. The fundamental wave choke channel 19*a* has a microwave energy propagating path which extends from the entrance 23 to a shortcircuit surface 15*a* as shown by an arrow, amounting to about $\lambda/4$, where $\lambda$ is a wavelength used, i.e., a free space wavelength of the dielectric heating frequency. The fundamental wave choke channel 19*a* is disposed close to the heating chamber 11 and has one wall surface 16*a* which is covered with a thin insulating coating, such as for example a porcelain enamel coating, and makes surface contact with the peripheral edge 18 of the access opening of the heating chamber. The second higher harmonic choke channel 19*b* has a microwave energy propagating path which extends from the entrance 23 to a short-circuit surface 15*b* as shown by another arrow, amounting to about $\lambda/8$. The entrance 23 is defined by opposing parallel surface members 15*d* and 16*b* which project toward the interior of the microwave energy attenuating cavity 19, making a gap between the projecting surface members 15*d* and 16*b* a microwave energy propagating path portion vertical to the opening peripheral edge 18 so that each of the respective microwave energy propagating paths in the fundamental wave choke channel 19*a* and second higher harmonic choke channel 19*b* runs in a direction vertical to and then bends in a direction parallel to the peripheral edge 18**.

Accordingly, the door 2 advantageously has a reduced thickness D in a direction vertical to the opening peripheral edge 18 and the microwave energy attenuating cavity 19 advantageously has a reduced width W in a direction parallel to the opening peripheral edge 18, thereby making the door 2 reduced in size and in thickness. This ensures the provision of a microwave heating apparatus in which the volume ratio (space factor) of the heating chamber 11 to the overall size of the apparatus can be improved. The large space factor of the heating chamber is convenient for a built-in type heating apparatus and a heating apparatus to be installed at a narrow space, adaptable to a thin electronic control panel, and advantageous from the standpoint of design.

Figure 4:
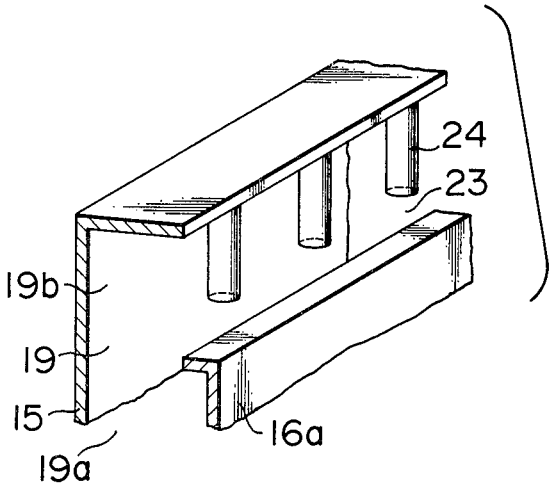
FIGS. 4 to 6 are fragmentary perspective views illustrative of the process of modifying matching posts as shown in FIGS. 4 and 5 to form a wall surface of a second higher harmonic choke channel in the form of an array of trapezoidal metal pieces each having a bent tip as shown in FIG. 6.
Figure 5:
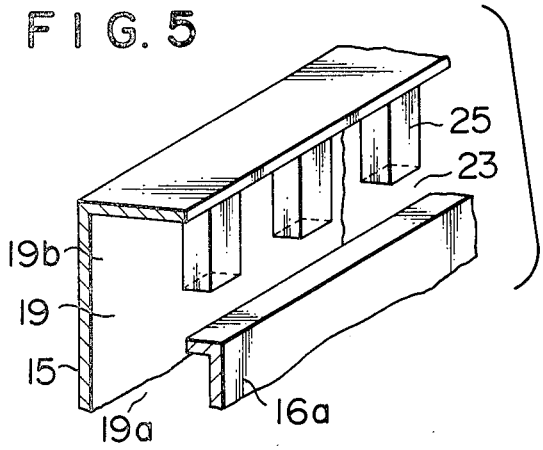
Figure 6:
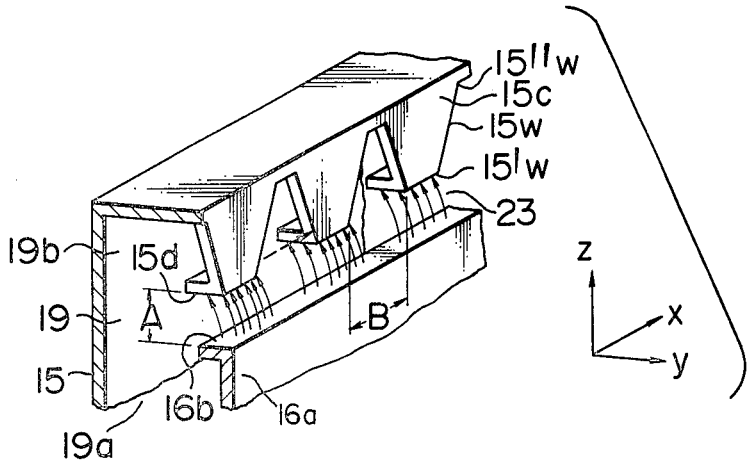

FIGS. 4 to 6 show the process of improvement in the seal structure according to the invention in which the arrangement of matching posts 24 and 25 as shown in FIGS. 4 and 5 are modified to be practical trapezoidal metal pieces 15W formed on a wall surface **15*c* of the second higher harmonic choke channel as shown in FIG. 6. In a microwave energy attenuating cavity 19 shown in FIG. 4, a plurality of round conductor bars 24, i.e., matching posts known as matching elements in microwave theory are provided at an entrance 23. Microwave energy which would leak to the outside without the matching posts can efficiently be guided to the microwave energy attenuating cavity 19 by selecting the length and diameter of the round conductor bar 24 and the interval of arrayed bars. If microwave energy propagating paths extending in two directions within the microwave energy attenuating cavity 19 have lengths of about $\lambda/4$ and $\lambda/8$, respectively, as shown in FIG. 3, the cavity 19 has high impedances against the fundamental wave and the second higher harmonic at the entrance 23. Part of microwave energy passes by the entrance 23 of the microwave energy attenuating cavity 19 and leaks to the outside. To reduce this leakage of microwave energy, it is necessary to reduce the average conductive surface distance between each the round conductor bar 24 and the access opening peripheral edge 18 of the heating chamber so as to lower the impedance therebetween, thereby making large the reflection of microwave energy between this low impedance portion and the high impedance portion at the entrance 23. In this respect, the square conductor bar 25 as shown in FIG. 5 is more preferable than the round conductor bar 24 of FIG. 4. However, the space volume of a second higher harmonic choke channel 19*b* having one wall surface in the form of an array of the square conductor bars 25 is reduced by a volume occupied by the square conductor bars 25**, resulting in reduction in Q of resonance and impairment of attenuating efficiency.

Figure 7:
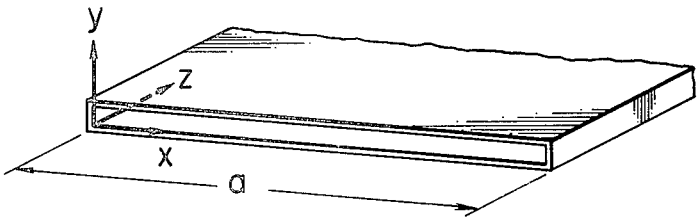
FIG. 7 is a fragmentary perspective view schematically showing a waveguide.

Thus, according to a preferred embodiment of the invention, a periodic structure is provided which comprises trapezoidal metal pieces 15W each having a bent tip as shown in FIG. 6. This periodic structure can maintain matching element function as attained by the round conductor bar 24 and square conductor bar 25 while eliminating the above disadvantages. With reference to FIGS. 6 and 7 and the following Table, description will be made as to how the trapezoidal metal pieces 15W operate near the entrance 23 of the microwave energy attenuating cavity 19.

TABLE 1

| a (mm) | Transmission mode | $\lambda_c$ (mm) | $\lambda_g$ (mm) | $\frac{\lambda_g}{2}$ (mm) | $x_{max}$ (mm) | Total number of maximum electric field points |
|---|---|---|---|---|---|---|
| 365 | $TE_{10}$ | 730 | 124 | 31 | 183 | 13 |
| | $TE_{20}$ | 365 | 130 | 32 | 91, 274 | |
| | $TE_{30}$ | 243 | 141 | 35 | 61, 183, 304 | |
| | $TE_{40}$ | 183 | 164 | 41 | 46, 137, 229, 319 | |
| | $TE_{50}$ | 146 | 410 | 102 | 37, 110, 183, 256, 329 | |
| 260 | $TE_{10}$ | 520 | 126 | 31 | 130 | 10 |
| | $TE_{20}$ | 260 | 139 | 35 | 65, 195 | |
| | $TE_{30}$ | 173 | 173 | 43 | 43, 130, 217 | |
| | $TE_{40}$ | 130 | 361 | 90 | 33, 98, 163, 228 | |

The above Table shows characteristics of a waveguide as shown in FIG. 7 and is useful to explain microwave energy sealing effect of the periodic structure as shown in FIG. 6. In Table, a: dimension in x direction of the waveguide (mm);

$\lambda_c$: cut-off wavelength (wavelength in x direction, $\lambda_c = 2a/m$), (mm);

$\lambda_g$: guide wavelength (wavelength in Z direction, $$\lambda_g = \frac{\lambda}{\sqrt{1 - \left(\frac{\lambda}{\lambda_c}\right)^2}}\text{), (mm);}$$

m: the number of maximum electric field points in x direction in each mode;

$\lambda$: free space wavelength (122.3 mm for 2,450 MHz), (mm); and $x_{max}$: maximum electric field position in x direction, $$x_{max} = \frac{N \cdot a}{2m} \quad (N = 1, 3, 2m - 1).$$

The microwave tending to leak to the outside from the heating chamber is generally of a high order mode having a number of maximum electric field points $x_{max}$ in a longitudinal direction (x direction) of a contact interface between the peripheral edge 18 of the access opening of the heating chamber and the door 2. For example, it is assumed that a heating chamber 11 having an access opening of 365 (mm)×260 (mm) corresponds to the waveguide of FIG. 7 and 2,450 MHz microwave energy propagates in the waveguide which has a propagation direction of Z direction corresponding to a direction in which the microwave energy leaks. In this case, for the dimension a in the longitudinal direction being 365 mm, five kinds of high order mode $TE_{10}$ to $TE_{50}$ are permitted to propagate and for the dimension a being 260 mm, four kinds of high order mode $TE_{10}$ to $TE_{40}$ are permitted to propagate. The total number of maximum electric field points $x_{max}$ is 13 for the dimension a being 365 mm and 10 for the dimension a being 260 mm. In the heating chamber 11, there is provided an electric field stirrer, such as the turntable 12, a rotary antenna or the like, for reducing irregularity of heating and the maximum electric field points $x_{max}$ will therefore vary with time. Further, it depends on various factors, such as the resonance mode in the heating chamber 11, the coupling position of the waveguide 10, the position and quantity of the load, and the operating point of the microwave oscillator, which high order mode intrudes in Z direction as the leakage microwave energy, and analysis of the microwave leakage intrusion is difficult. If the trapezoidal metal pieces 15W are provided at the maximum electric field positions $x_{max}$, the most effective result will be expected. Practically, the maximum electric field positions $x_{max}$, however, unstable. Accordingly, it is considered to arrange the trapezoidal metal pieces equi-distantly. Then, in order to cause the trapezoidal metal pieces 15W to correspond to the maximum electric field positions $x_{max}$ in all of the high order modes, the trapezoidal metal pieces 15W are required to be arranged at 26 mm pitches, the dimension of pitches being equal to a quotient of dividing the 365 mm longitudinal (x direction) length of the access opening of the heating chamber 11 by 14 which is the total number of the maximum electric field points of 13 plus 1; and for the longitudinal length of the heating chamber opening being 260 mm, the trapezoidal metal pieces 15W are required to be arranged at 24 mm pitches, the dimension of pitches being equal to a quotient of dividing the 260 mm longitudinal length by 11 which is the total number of the maximum electric field points of 10 plus 1. Practically, from the economical point of view, the trapezoidal metal pieces 15W are arranged at the same pitches without strictly corresponding to the quotient. Thus, the dimension of pitches may preferably be 25 mm for the two cases exemplified herein. A gap B between adjacent trapezoidal metal pieces 15W near tips 15'W is made larger than a gap A of the entrance of the microwave energy attenuating cavity 19 so as to facilitate concentration of Z-direction electric field at the tips 15'W. Consequently, the trapezoidal metal pieces 15W exert on the electric field being scattered near the entrance 23 so as to increase a Z-direction component of electric field (solid line arrows in FIG. 6) which propagates into the microwave energy attenuating cavity 19 and decrease an x-direction component of electric field (dotted line arrow in FIG. 6) which does not propagate into the cavity 19. In other words, the trapezoidal metal pieces 15W act as the matching elements adapted to efficiently guide the microwave energy in all of the high order modes, which would leak to the outside through a gap between the peripheral edge 18 of the access opening of the heating chamber and the door 2 without these elements, into the microwave energy attenuating cavity 19, thereby reducing the leakage of microwave energy to the outside. In addition, the microwave energy propagation path lengths in the two directions within the microwave energy attenuating cavity 19 amount to about λ/4 and λ/8 as shown in FIG. 3 and have high impedances against the fundamental wave and the second higher harmonic, respectively. The wall surface 16*a* of the fundamental wave choke channel 19*a* makes surface contact to the peripheral edge 18 of the access opening of the heating chamber upon closure of the door 2, so that the gap between them can be decreased to thereby reduce leakage of the microwave energy which would pass through the contact interface. Further, because of the low impedance (characteristic impedance for the transmission line) at the contact interface, and therefore because of the large reflection between this low impedance and the high impedance at the entrance 23, the intensity of the microwave energy reaching the trapezoidal metal pieces 15W can be reduced. The trapezoidal metal pieces 15W acting as the matching elements are effective to efficiently guide into the microwave energy attenuating cavity 19 the weak microwave energy which in turn is held as storage energy within the interior space of the cavity 19 and is partly consumed as power loss at the wall surface.

Further, the gap B between the tips 15'W of adjacent trapezoidal metal pieces 15W is made λ/4 or less. This dimensional limitation corresponds to ½ of the wavelength of the second higher harmonic entering the second higher harmonic choke channel, providing a cut-off region, and constitutes a necessary condition for preventing the second higher harmonic which has once entered the channel 19*b* from leaving out thereof.

Furthermore, each of the trapezoidal metal pieces 15W has a larger width at its root 15''W than that at its tip 15'W to ensure that the dimensional relation of λ/4>gap B>gap A can be held and the conductor surface area of the metal piece 15W opposing the peripheral edge 18 of the access opening of the heating chamber can be increased, thereby decreasing the impedance between the two conductor surfaces 15W and 18 and increasing the reflection between this low impedance and the high impedance at the entrance to reduce the leakage of microwave energy passing through the entrance 23 to the outside. The feature that the width of each root 15''W is larger than that of each tip 15'W is also effective to increase mechanical strength of the trapezoidal metal piece 15W and hence prevents any deformation of the metal piece responsible for degradation of microwave energy leakage preventive efficiency.

As shown in FIG. 6, the tip 15'W of the trapezoidal metal piece 15W is bent to merge into the projecting surface 15*d* which opposes the projecting surface 16*b* at the edge of the door rear plate 16*a*, thus providing opposing surfaces substantially in parallel relation. Consequently, the electric field can be established as shown by arrows without being intensified locally. This eliminates such inconvenience as spark or abnormal heating due to a microwave magnetic field which is liable to occur at the contact interface between the door rear plate 16*a* and the access opening peripheral edge 18 at the time of heating operation with no load. The projecting surface 15*d* corresponds to a circular or rectangular end surface at the tip of the matching post 24 or 25.

Figure 8A:
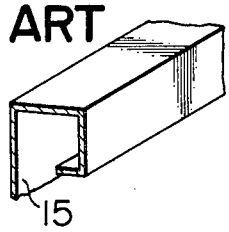
FIG. 8A PRIOR ART
FIGS. 8A to 8C are fragmentary perspective views respectively showing a prior art choke structure without slits, another prior art choke structure with slits, and a choke structure embodying the invention with trapezoidal metal pieces having bent tips.
Figure 8B:
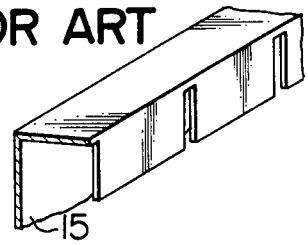
FIG. 8B PRIOR ART
Figure 8C:
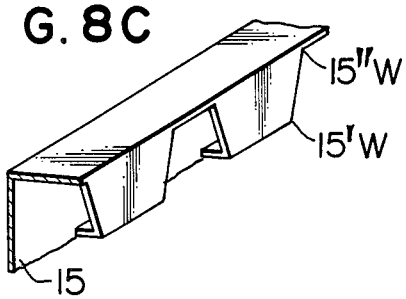
Figure 8D:
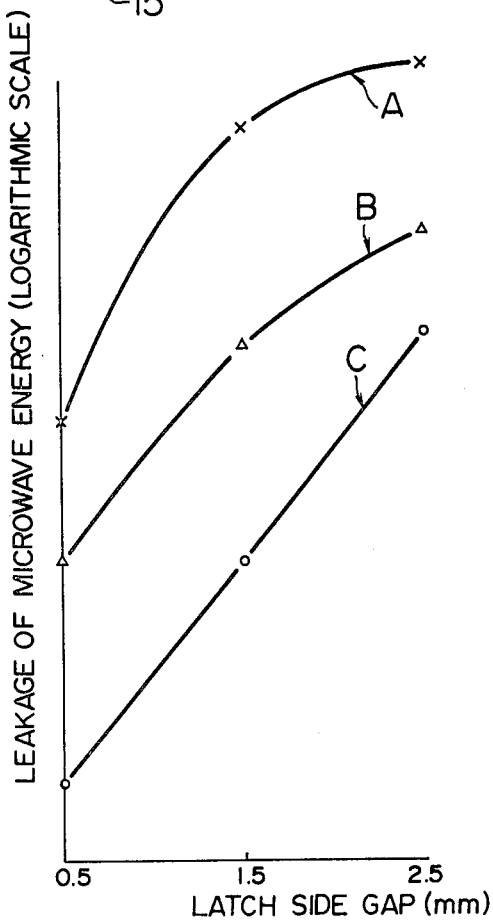
FIG. 8D is a graph showing amounts of microwave energy leakage at the door in accordance with the respective choke structures of FIGS. 8A, 8B and 8C.

FIG. 8D shows amounts of microwave energy leakage when water, 275 ml in volume, in a beaker placed on the turntable 12 is heated under the application of 700 W microwave energy at 2,450 MHz to the heating chamber 11 having an access opening of 365 (mm)×260 (mm), where abscissa represents latch side gap equivalent to the contact interface gap between the peripheral edge 18 of the access opening of the heating chamber and the door rear plate 16*a*. In FIG. 8D, curve A represents microwave energy leakage characteristics obtained with a second higher harmonic choke channel 19*b* as shown in FIG. 8A having a flat wall surface 15*c* opposing the peripheral edge 18 which is removed of the slits or trapezoidal metal pieces 15W. Curve B represents leakage characteristics obtained with a channel 19*b* as shown in FIG. 8B having slits of a length of λ/12 (about 10 mm) which are formed in a wall surface 15*c*. Curve C represents leakage characteristics obtained with a channel 19*b* as shown in FIG. 8C having a wall surface 15*c* in the form of an array of the trapezoidal metal pieces 15W each having a length of λ/12 (about 10 mm) between the root 15''W and the tip 15'W. As seen in FIG. 8D, as the characteristics shift in the order of curve C, curve B and curve A, the amount of microwave energy leakage decreases. Specifically, the microwave energy leakage is minimal in the microwave heating apparatus with the door 2 having the trapezoidal metal pieces 15W. This type of door can dispense with ferrite or conductive rubber typically used for promoting the attenuating efficiency of the choke structure and can be suited for reduction in cost.

When the door seal of the present invention was incorporated in a microwave heating apparatus of 700W microwave energy at 2,450 MHz, the microwave attenuating cavity 19 as shown in FIG. 3 was so dimensioned as to have a dimension D of 16 mm in the thickness direction of the door 2 and a width W of 40 mm, and in the array of the trapezoidal metal pieces 15W as shown in FIG. 6, the length between the root 15''W and the tip 15'W was about 10 mm (λ/12), the gap B between adjacent tips 15'W was 15 mm and the gap A of the entrance was about 5 mm, it was confirmed experimentally that the microwave energy leakage from the door periphery can be reduced to an extent which is satisfactory for practical purposes.

Figure 9:
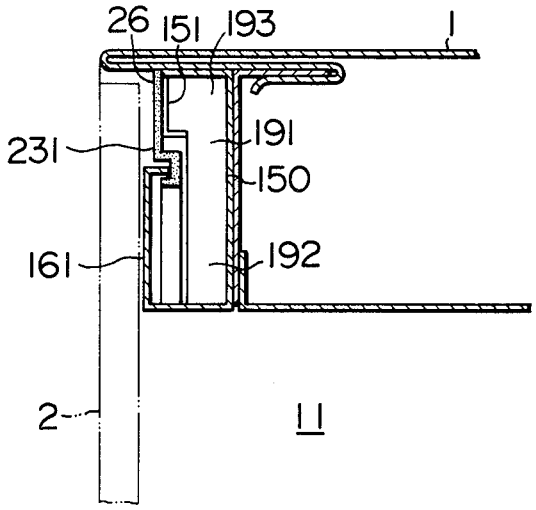
FIG. 9 is a fragmentary sectional elevation showing another embodiment of the invention.

Although in the foregoing embodiment the microwave energy attenuating cavity is provided for the door per se, the same effect may be obtained by providing a microwave energy attenuating cavity in an enclosure of the heating chamber 11. FIG. 9 shows an essential part of another embodiment of the invention wherein a microwave energy sealing structure is provided in the enclosure per se. A microwave energy attenuating cavity 191 as shown in FIG. 1 is constituted by a fundamental wave choke cavity 192 and a second higher harmonic choke cavity 193. The enclosure is partitioned by a metal plate 150 to define the cavity 191. The metal plate 150 is provided at one end with a periodic structure 151 comprised of an array of trapezoidal metal pieces as shown at 15W in FIG. 6, with the other end terminating in an edge portion 161 which opposes a rear plate 16 (FIG. 2) of a door 2. A peripheral edge of the door 2 opposing the microwave energy attenuating cavity 191 must have a metal surface. Also, at least one of the opposing peripheral edge 161 and the rear plate 16 of the door 2 is preferably covered with an insulating thin coating, for example, a porcelain enamel coating at the contact interface.

As has been described, the present invention attains the following effects:

(a) The microwave energy attenuating cavity provided in the door becomes compact to reduce size and thickness of the door, leading to the microwave heating apparatus which is improved in space factor;

(b) The amount of materials used for parts of the door can be reduced and cost can advantageously be reduced;

(c) Since the tips of the trapezoidal metal pieces 15W constituting the periodic structure and the edge of the door rear plate **16*a* constitute parallel flat surfaces which oppose to each other, it is possible to eliminate spark or abnormal heating occurring at the contact interface between the door and the peripheral edge of the access opening of the heating chamber at the time of heating operation with no load; and (d) Since each of the trapezoidal metal pieces 15W has the width at the root 15''W which is larger than that at the tip 15'W, and the length between the root 15''W and the tip 15'W which is about $\lambda/12$ that is far shorter than $\lambda/4$ of the conventional slit length, mechanical strength of the trapezoidal metal pieces 15W** can be increased to prevent any deformation of the metal piece responsible for degradation of microwave energy leakage preventive efficiency.

What is claimed is:

1. A microwave heating apparatus comprising:

a heating chamber for heating an object to be heated by microwave energy, said heating chamber having an access opening;

a door for opening and closing said access opening of said heating chamber;

a first surface member circumferentially surrounding said access opening;

a second surface member provided on the door and making surface contact with said first surface member;

a first projecting surface of said second surface member formed by bending a circumferential edge portion of said second surface member substantially at right angles;

a periodic structure including metal pieces which extend periodially from a peripheral edge of said door and have each a tip surface opposing said first projecting surface substantially in parallel relationship therewith;

a fundamental wave choke channel established to extend along the back of said second surface member, said fundamental wave choke channel having an entrance at a gap between the tip surface of the periodic structure and said first projecting surface and a first microwave energy propagating path of substantially $\frac{1}{4}$ of a wavelength used, said first path having a portion extending in a direction vertical to said first surface member and another portion extending in a direction parallel to said first surface member; and a second higher harmonic choke channel established to extend along the back of the periodic structure, said second higher harmonic choke channel having the same entrance as the fundamental wave choke channel and a second microwave propagating path of substantially $\frac{1}{8}$ of the used wavelength, said second path having a portion extending in a direction vertical to said first surface member and another portion extending in a direction parallel to said first surface member.

2. A microwave heating apparatus according to claim 1, wherein said periodic structure comprises trapezoidal metal pieces for efficiently guiding leakage microwave energy into said fundamental wave choke channel and said second higher harmonic choke channel, each of said trapezoidal metal pieces having a second projecting surface formed by bending its tip substantially at right angles with respect to said first surface member, said second projecting surface opposing said first projecting surface substantially in parallel relationship therewith.

3. A microwave heating apparatus according to claim 1 or 2, wherein a gap between adjacent tips of said periodic structure is made larger than said gap between the tip surface of said periodic structure and said first projecting surface and made less than $\frac{1}{4}$ of the used wavelength.

4. A microwave heating apparatus according to claim 1 or 2, wherein said metal pieces are disposed along the whole circumferential edge portion of said door, a total number of said metal pieces being substantially equal to a total number of maximum electric field points in high order modes present in a longitudinal direction of a contact interface between said first and second surface members in accordance with the size of said access opening of said heating chamber.

5. A microwave heating apparatus according to claim 2, wherein each of said trapezoidal metal pieces has a width, at its root, which is larger than that at its tip, and a length between its root and its tip which is about $\lambda/12$.

* * * * *